US005269648A

United States Patent [19]

Freuschle

[11] Patent Number: 5,269,648

[45] Date of Patent: Dec. 14, 1993

[54] ARRANGEMENT FOR CONTROLLING THE FLOW CROSS SECTION OF A TURBOMACHINE

[75] Inventor: Dieter Freuschle, Waldshut, Fed. Rep. of Germany

[73] Assignee: Asea Brown Boveri Ltd., Baden, Switzerland

[21] Appl. No.: 854,909

[22] Filed: Mar. 20, 1992

[30] Foreign Application Priority Data

Apr. 8, 1991 [CH] Switzerland ..... 1022/91

[51] Int. Cl.[5] ..... F01D 17/18

[52] U.S. Cl. ..... 415/148; 415/149.2; 415/151; 415/154.2

[58] Field of Search ..... 415/148, 149.1, 149.2, 415/149.4, 150, 151, 152.1, 152.2, 153.1, 153.2, 154.1, 154.2, 154.3

[56] References Cited

U.S. PATENT DOCUMENTS

| | | | |
|---|---|---|---|
| 707,727 | 8/1902 | Schulz | 415/149.1 |
| 746,388 | 12/1903 | Scheffler | 415/149.1 |
| 884,719 | 4/1908 | Cramp | 415/149.4 |
| 958,430 | 5/1910 | Parsons | 415/149.2 |
| 3,209,537 | 10/1965 | Mock | 415/149.2 |

FOREIGN PATENT DOCUMENTS

| | | |
|---|---|---|
| 0419871 | 4/1991 | European Pat. Off. . |
| 630147 | 4/1936 | Fed. Rep. of Germany . |
| 428775 | 7/1967 | Switzerland . |
| 2076065 | 11/1981 | United Kingdom . |

OTHER PUBLICATIONS

Maschinenbautechnik, Berlin 38, 1989, pp. 17–19, K. Speicher, et al., "Zur Entwicuklung Von Niederdruck--Dampfsteuerorganen, Derzeitiger Stand Und Kunftige Moglichkeiten".

*Primary Examiner*—John T. Kwon

*Attorney, Agent, or Firm*—Oblon, Spivak, McClelland, Maier & Neustadt

[57] ABSTRACT

An arrangement for controlled admission to a nozzle assembly of axial flow extraction steam turbines consists essentially of a control valve located upstream of the nozzle assembly and having two inlet windows for the working medium and of a duct element located between the control valve and the nozzle assembly. The duct element is provided with a plurality of inlet flow ducts which connect the inlet windows of the control valve to the nozzles of the nozzle assembly. The control valve is rotatable by 180° in the peripheral direction for increasing the opening or closing of the inlet flow ducts.

4 Claims, 3 Drawing Sheets

ARRANGEMENT FOR CONTROLLING THE FLOW CROSS SECTION OF A TURBOMACHINE

BACKGROUND OF THE INVENTION

1. Field of the Invention

The invention concerns an arrangement for controlled admission to the nozzle assembly of axial flow turbomachines, in particular extraction steam turbines, having a control valve which is located upstream of the nozzle assembly and has at least two inlet windows for the working medium.

2. Discussion of Background

In steam turbines, nozzle group control is particularly suitable for installations from which high part-load efficiencies are demanded. The first turbine stage, also referred to as the control stage, is usually equipped with impulse or Curtis blading and has several admission sectors, the steam flow from the steam generator to each of the admission sectors being adjusted by a special control valve. It is usual to open one control valve after the other in a continuous manner with increasing output of the steam turbine. At a given load condition, therefore, a larger or smaller number of control valves is in general fully opened and there is, therefore, no throttling. Only one of the control valves is partially opened and causes an additional throttling loss. This loss can be kept to a modest amount because it only affects the partial mass flow flowing through the relevant control valve and this partial quantity becomes smaller as the number of admission sectors becomes larger. It follows from this that an infinitely large number of control valves and admission sectors should, ideally, be provided. In practice, machines are even known which have up to 10 admission sectors and associated control valves and therefore permit very sensitive control. The most common arrangement, however, is one with 4 segments; almost all reheated turbines now operate in this manner. In the case of 4 valves, it is therefore possible to arrange a nozzle distribution of 20%, 20%, 30%, 30% around the periphery. By this means, it is possible to operate valve points when the machine is running with approximately the following powers: 30%, 60%, 90%, 100%. With the high steam temperatures now usual, the nozzle areas first opened are usually arranged symmetrically in the lower part and the upper part of the casing so that asymmetrical temperature distributions are avoided when starting up.

Arrangements for controlling the flow cross section of a turbomachine are also used in steam extraction turbines. They permit a variable mass flow of steam to be branched off—for process purposes, for example. In the case of conventional, axial flow steam turbines, such controlled extraction systems are known in which, after flowing through one turbine section, the whole of the mass flow is led out of the turbine, controlled and subsequently reintroduced into the following turbine section. For each internally controlled bleed a plurality of sequentially opening relief adjustment valves are flanged onto the turbine casing; these control the quantity of steam flowing into the subsequent turbine section and, by this means, keep the extraction pressure constant.

Also known are arrangements by means of which the free flow cross section in the nozzle assembly is modified to control the steam mass flow, likewise in the form of adjustable guide vanes. The guide vanes can, for example, be rotated about their own longitudinal axis in order to reduce the cross section. The center of rotation can be at the leading edge of the vane, within the vane profile or at the trailing edge of the vane. In all these variants, the flow cross section can be completely shut off during an adjustment. In addition, the vane geometry, which is important for aerodynamic reasons, is maintained. In these arrangements, however, the inlet flow to the guide vanes and the outlet flow from them is modified to a greater or lesser extent and this impairs the mode of operation of at least those rotor blades which immediately follow.

Arrangements of the type quoted at the beginning are known from the journal article "Zur Entwicklung von Niederdruck-Dampfsteuerorganen, derzeitiger Stand und zukünftige Möglichkeiten" (The development of low pressure steam control units, current status and future possibilities), Maschinenbautechnik, Berlin, 38 (1989), pages 17 ff. In a first variant, the working medium, low pressure steam in this case, enters an annular chamber upstream of the guide vane cascade via radial rotary valves with a large number of inlet windows which can be shut off. In a second variant, the working medium enters the guide blading directly via axial rotary valves with a large number of inlet windows which can be shut off. Both arrangements are suitable for throttling control, the rotary valves being displaced by one window pitch at a time from the fully open condition to the fully shut-off condition.

SUMMARY OF THE INVENTION

The object of the invention is to provide a simple adjustment device for nozzle group control while avoiding the number of control valves mentioned above, the inlet flow conditions to the nozzle assembly and the outlet flow conditions from the nozzle assembly remaining unaltered.

According to the invention, this is achieved by locating between the control valve and the nozzle assembly a duct element with a plurality of inlet flow ducts which connect the inlet window of the control valve to the nozzles of the nozzle assembly, the control valve being rotatable by 180° in the peripheral direction for increasing the opening or closing of the inlet flow ducts.

It is desirable for the working medium to be admitted to each individual nozzle of the nozzle assembly via its own inlet flow duct.

Apart from the simplicity of the measure taken, the advantages of the invention are particularly to be seen in the high efficiency which can be achieved. On the one hand, it is possible to run at a large number of loss-free operating points and, on the other, the inlet flow of the admission to the particular nozzles in operation is optimum.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of two illustrative examples, wherein.

DESCRIPTION OF THE PREFERRED EMBODIMENTS

Figure 1:
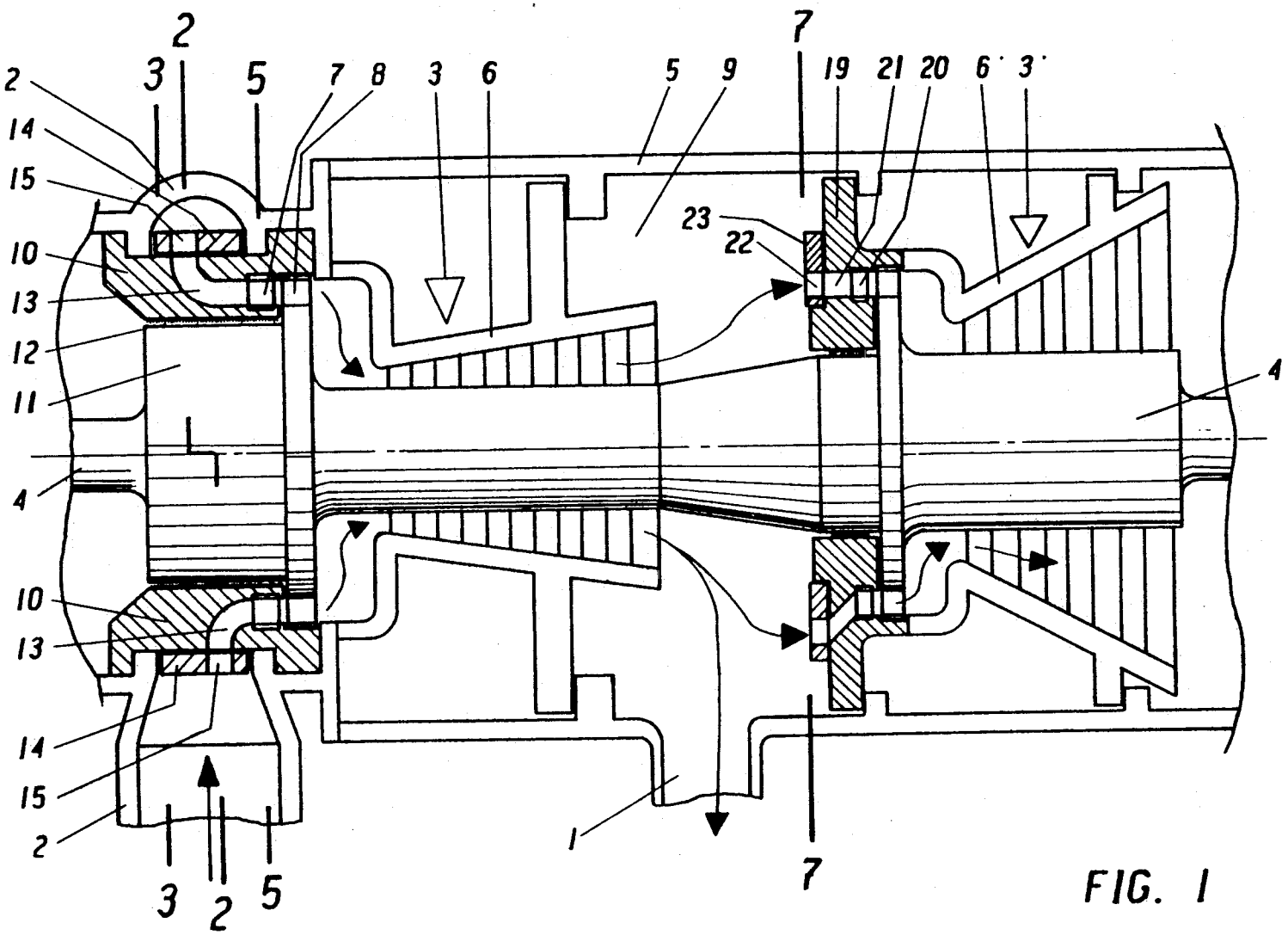
FIG. 1 shows a diagrammatic longitudinal section through an extraction steam turbine.

Referring now to the drawings, wherein like reference numerals designate identical or corresponding parts throughout the several views, where the flow direction of the working medium is indicated by arrows and where only the elements essential to the understanding of the invention are shown (parts of the installation not shown are, for example, the actual inlet elements, the bearings including their bearing housings, the various extraction points, the exhaust steam part and the driven element, for example a generator), the extraction turbine shown in FIG. 1 is a single-shaft two-part turbine with internally controlled bleed 1 for process steam, for example. The turbine consists of a high pressure turbine 3 of the back pressure type and a low pressure turbine 3' of the condensing type. The latter is necessary to compensate for fluctuations in the output requirement of the operation if, for example, the frequency must be maintained as well as the controlled steam pressure at the bleed 1.

The rotor blades of the two-part turbines are located on a common rotor 4. The vane carriers 6, 6' are suspended in the substantially cylindrical turbine casing 5 so that they can move under the action of heat. The live steam flows via an inlet casing 2 connected to the turbine casing 5 into the nozzle assembly 7 of the high pressure turbine 3, from where it is admitted to the control stage blading of the control wheel 8. This control stage blading generally operates on the impulse principle and is designed as a single stage in the case shown. The steam subsequently flows through the reaction blading (only symbolically represented) of the high pressure turbine 3 and passes into the high pressure exhaust steam space 9. In contrast to the solution mentioned at the beginning with relief adjustment valves, the steam which has to be further expanded remains within the turbine casing 5. The steam not extracted into 1 flows through the low pressure turbine 3', from whose outlet it passes into the exhaust steam casing (not shown) and from there into a condenser, on whose cooled tubes the now expanded steam is precipitated.

To this extent, extraction-condensing turbines are known. The new control arrangement can be employed both on the high pressure turbine 3 for controlling the live steam and on the low pressure turbine 3' for controlling the extraction.

According to FIG. 1, the nozzle assembly 7 on the high pressure turbine consists of a nozzle box which is integrated into a duct element 10 designed as a ring. Depending on the steam data, the individual nozzles—in the present case 42 in number—can be either pressed into the duct ring and calked or else welded into the duct ring. The two-part duct ring, which is generally designed with a horizontal split plane, is suspended in the inlet casing 2, on the one hand, and its radially inner diameter surrounds the balance piston 11 of the high pressure turbine, on the other. Its inner periphery is provided with a labyrinth 12 extending over its axial extent for the purpose of forming the piston seal.

Figure 2:
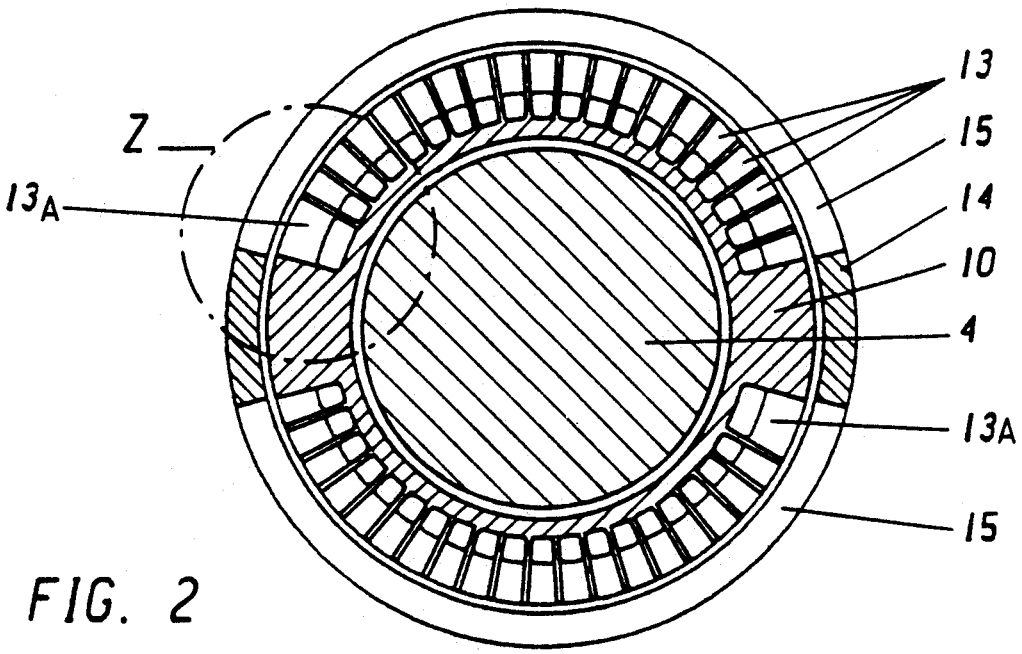
FIG. 2 shows a cross section, along line 2—2 in FIG. 1, through a first illustrative variant of the invention in the high pressure inlet section of the turbine.
Figure 5:
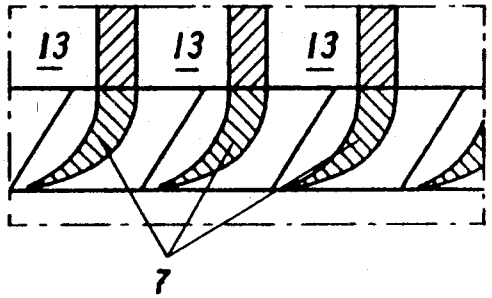
FIG. 5 shows the partial development of a cylindrical section in the plane of line 5—5 in FIG. 1 at half the height of the guide blading.
Figure 6:
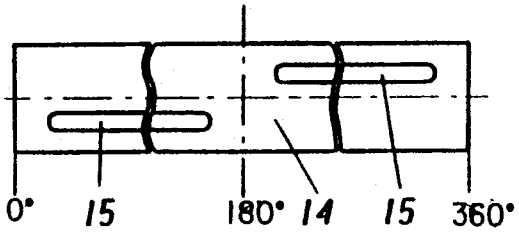
FIG. 6 shows the development of the adjustment element in the high pressure inlet section of the turbine.

As shown in FIG. 2, the duct ring 10 is provided with two symmetrically arranged sectors of inlet flow ducts 13 over its periphery. These inlet flow ducts, of which each sector has 20, each enter a nozzle of the nozzle assembly (FIG. 5). This ensures optimum inlet flow to the nozzles. In the present case, only the first inlet flow duct 13*a* to open during starting up of the machine extends over two nozzle pitches. This is done to keep the mechanical loads on the control wheel within limits. The dimensions of the inlet flow ducts remain unaltered. Matching to the swallowing capacity of the blading advantageously takes place by means of the selection of the geometry of the nozzles. Thus, for example, their width over the periphery and/or their radial height can be matched to the particular conditions present. At the inlet end, the inlet flow ducts 13 are led radially out of the duct ring. The actual inlet openings of the ducts of the upper sector and of the lower sector are offset relative to one another in the axial direction (FIG. 1) and are therefore located in two different planes.

Figure 4:
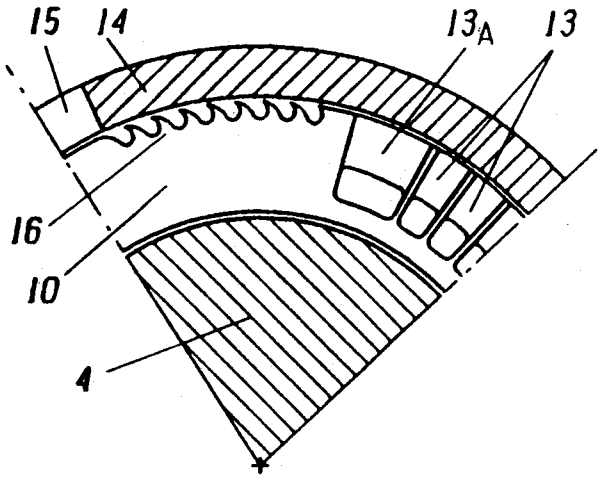
FIG. 4 shows a partial cross section through the control arrangement, in accordance with detail Z in FIG. 2, but in the closed condition.

In the inlet flow ducts 13, the steam passes via a control valve 14 provided with two inlet windows 15. This radial valve, again in two parts and designed with a horizontal split plane is—in the simplest case —a ring whose inner diameter surrounds the duct ring 10 and seals against it. During the operation of the machine, the ring must be capable of accepting the maximum pressure drop occurring in the closed condition, i.e. without a flow of steam into the inlet flow ducts, without any large deformation. Since the permanently open inlet window is subjected to working medium even in the condition without flow, the radial valve is equipped for sealing purposes with sealing strips (not shown) over its axial extent on both sides of the inlet window. The two inlet windows 15, which have the same axial offset relative to one another as the corresponding inlet openings of the inlet flow ducts 13, extend in the peripheral direction over an angular range corresponding to that of the associated 20 inlet flow ducts. It follows that the radial valve has to be rotatable by 180° from the fully closed to the fully open position. Since, in the closed position, sealing is necessary in the peripheral direction as well as to the side of the inlet window, the duct ring according to FIG. 4 is equipped with an appropriate indent seal in the plane of the interacting inlet windows and adjacent to the inlet flow ducts 13*a* in order to limit the leakage flow.

Figure 3:
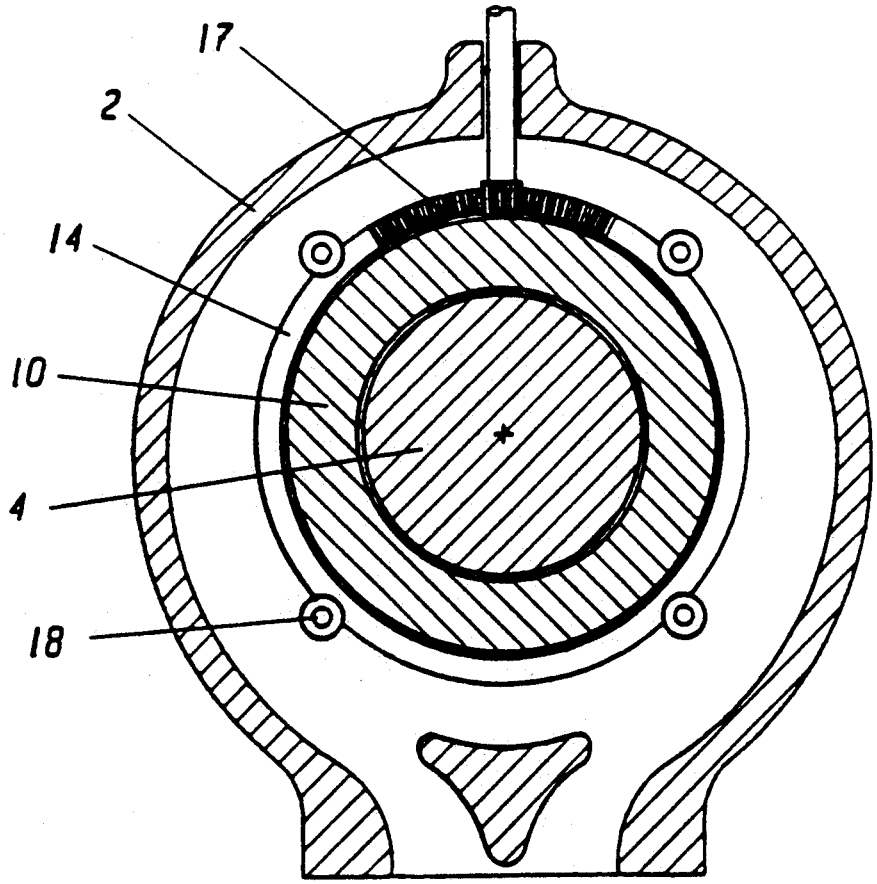
FIG. 3 shows a cross section, along line 3—3 in FIG. 1, through the high pressure inlet section of the turbine.

The rotation mentioned of the radial valve by 180° can take place in a simple manner, as shown in FIG. 3. On one of its end surfaces, the valve is provided with teeth 17 (only some of which are shown) over its periphery, an externally driven pinion introduced through the upper part of the inlet casing 2 engaging with these teeth. The support for the radial valve (only shown diagrammatically) takes place by means of four roller pins 18 uniformly distributed over the periphery.

During rotation from the closed condition (FIG. 4), the two opposite inlet flow ducts 13*a* open first and, with increasing rotation of the radial valve, working medium flows through further inlet flow ducts 13, respectively opposite to one another. In the present case, therefore, 20 so-called valve points, i.e. approximately loss-free operating points, are possible by means of the installation. The new solution therefore corresponds to the effect of 20 of the adjustment valves mentioned at the beginning. In addition, the fact that admission is always simultaneous to opposite inlet flow ducts permits even heating of the subsequent turbine part and avoids any additional bearing loads.

Figure 7:
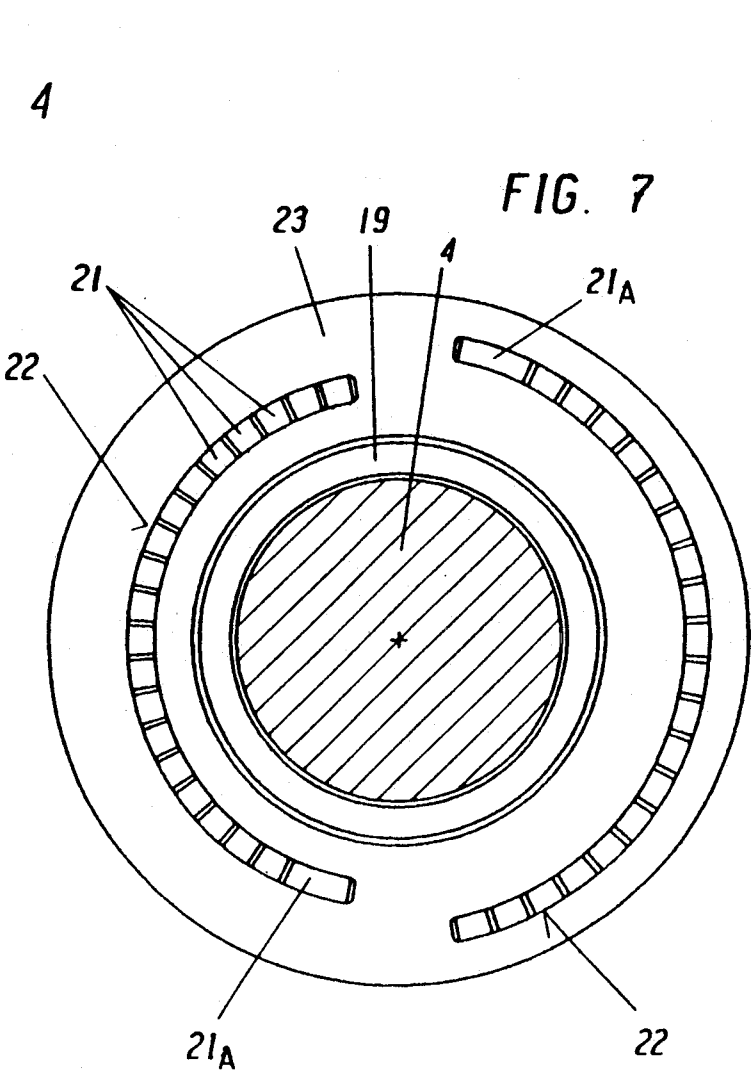
FIG. 7 shows a cross section, along line 7-7 in FIG. 1, through a second illustrative variant of the invention in the low pressure inlet section of the turbine.

FIG. 7 and the right-hand part of FIG. 1 show an illustrative example of the invention in the region of the internally controlled steam extraction. Since there are substantially lower steam pressures and also, therefore, lower pressure drops in this region, a simplified variant can be employed. This has the additional advantage that the axial flow direction of the steam is not interrupted at the bleed location. In addition, it is distinguished by a small axial overall length.

In this case, the duct element is a duct disk 19 into which is integrated the nozzle assembly 20 of the control stage. The two-part duct disk, which is again usually designed to have a horizontal split plane, is suspended in the turbine casing 5, on the one hand, and its radially inner diameter surrounds the low pressure rotor 4 of the turbine, on the other. On its internal periphery, it is provided with a labyrinth over its axial extent for the purpose of forming a seal.

The duct disk 19 is provided with two symmetrically arranged sectors of inlet flow ducts 21 over its periphery. These inlet flow ducts, of which each sector has 20, each enter a nozzle of the nozzle assembly 20. In the present case, only the inlet ducts 21*a*, which respectively open first and close last, extend over two nozzle pitches in order to keep the mechanical loads of the downstream control wheel within limits.

At the inlet end, the inlet flow ducts 21 are led out axially or obliquely to the axis from the duct disk 19. The actual inlet openings of the ducts of the upper sector and the lower sector are offset in the radial direction relative to one another and are therefore located at two different radial heights.

The steam which has not been extracted passes into the inlet flow ducts 21 via a control valve 23 provided with two inlet windows 22. This two-part axial valve, again designed with a horizontal split plane, is, in the simplest case, a disk which is in contact with the end surface of the duct disk, is guided there and seals against it. The two inlet windows 22, which have the same radial offset relative to one another as the corresponding inlet openings of the inlet flow ducts 21, extend in the peripheral direction over an angular range which corresponds to that of the associated 20 inlet flow ducts. It therefore follows that the axial disk must be rotatable by 180° from the fully closed to the fully open position.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the Unites States is:

1. An arrangement for controlled admission to a nozzle assembly of axial flow turbomachines, comprising:

a rotatable control valve located upstream of a nozzle assembly of an axial flow turbomachine, said control valve having two inlet windows for a working medium; and a duct element located between the control valve and the nozzle assembly, the duct element comprising a plurality of inlet flow ducts which connect the inlet windows of the control valve to nozzles of the nozzle assembly;

said two inlet windows of the control valve being offset in the axial direction relative to one another and is rotatable by 180° in a peripheral direction for increasing an opening or closing of the inlet flow ducts, such that the rotation of the control valve fully closes or opens one of said inlet flow ducts after another in succession based on a direction of rotation of said control valve.

2. The arrangement as claimed in claim 1, wherein the duct element is a duct ring and the control valve is a radial valve, a radially inner diameter of the duct ring surrounding a balance piston of a turbine and being surrounded on its radially outer diameter by the.

3. The arrangement as claimed in claim 5, wherein the duct element is a duct disk and the control valve is an axial valve, the two inlet windows in the axial valve being offset in the radial direction relative to one another.

4. The arrangement as claimed in claim 5, wherein the working medium is admitted to each nozzle of the nozzle assembly via its own inlet flow duct.

* * * * *